US008102124B2

(12) United States Patent
Hung et al.

(10) Patent No.: US 8,102,124 B2
(45) Date of Patent: Jan. 24, 2012

(54) INVERTER CIRCUIT FOR LIGHT SOURCE

(75) Inventors: Tsung-Liang Hung, Jhongli (TW); Yi-Hsun Lin, Jhongli (TW); Chia-Hsin Tseng, Jhongli (TW)

(73) Assignee: Ampower Technology Co., Ltd., Jhongli, Taoyuan County (TW)

( * ) Notice: Subject to any disclaimer, the term of this patent is extended or adjusted under 35 U.S.C. 154(b) by 492 days.

(21) Appl. No.: 12/420,806

(22) Filed: Apr. 8, 2009

(65) Prior Publication Data

US 2009/0302768 A1 Dec. 10, 2009

(30) Foreign Application Priority Data

Jun. 4, 2008 (CN) ..... 2008 1 0067584

(51) Int. Cl.
*H05B 41/292* (2006.01)

(52) U.S. Cl. ..... 315/127; 315/291; 315/307

(58) Field of Classification Search ..... None
See application file for complete search history.

(56) References Cited

U.S. PATENT DOCUMENTS

2002/0014905 A1* 2/2002 Kumagai ..... 327/333
2005/0024900 A1* 2/2005 Hachiya ..... 363/24
2005/0035729 A1* 2/2005 Lev et al. ..... 315/291

* cited by examiner

*Primary Examiner* — Shawki S Ismail
*Assistant Examiner* — Crystal L Hammond
(74) *Attorney, Agent, or Firm* — Altis Law Group, Inc.

(57) ABSTRACT

An inverter circuit drives a light source module. An input signal circuit provides electrical signals. A power stage circuit converts the electrical signals to square-wave signals. A transformer circuit converts the square-wave signals to alternating current (AC) signals capable of powering the light source module. A voltage detection circuit detects voltage applied on the light source module so as to output a detected voltage signal. A feedback circuit feeds current flowing through the light source module so as to output a current feedback signal. A protection circuit is connected to the voltage detection circuit and the feedback circuit, for outputting a latch signal according to the detected voltage signal or the current feedback signal. A pulse-width modulation control circuit outputs a switch signal to the power stage circuit according to the latch signal. The input signal circuit also provides the electrical signals to the protection circuit.

18 Claims, 5 Drawing Sheets

INVERTER CIRCUIT FOR LIGHT SOURCE

BACKGROUND

1. Technical Field

Embodiments of the present disclosure relate to inverter circuits, and particularly to an inverter circuit with a protection circuit.

2. Description of Related Art

Discharge lamps, such as Cold Cathode Fluorescent Lamps (CCFLs) and External Electrode Fluorescent Lamps (EEFLs), have been broadly used as light sources in liquid crystal display (LCD) systems. The discharge lamps are often driven by high voltage. To protect the discharge lamps and ensure proper operation, a detection circuit detects voltage applied to the discharge lamps and current flowing through the discharge lamps.

FIG. 5 shows a commonly used inverter circuit for powering a light source module 14. The inverter circuit comprises an input signal circuit 10, a power stage circuit 11, a transformer circuit 12, a voltage detection circuit 13, a feedback circuit 15 and a pulse-width modulation (PWM) control circuit 16. The PWM control circuit 16 comprises a PWM controller and driving circuit 161 and a latch signal generator 162.

In a normal status, the PWM controller and driving circuit 161 controls output of the power stage circuit 11 according to a feedback signal to adjust current flowing through the light source module 14. In an abnormal status of the inverter circuit, the voltage applied to or current flowing through the light source module 14 exceeds individual predetermined threshold, and the latch signal generator 162 generates a latch signal according to the output of the voltage detection circuit 13 or the feedback circuit 15. In addition, the PWM controller and driving circuit 161 outputs a switch signal according to the latch signal to the power stage circuit 11, to cut power to the light source module 14.

Frequently, the PWM controller and driving circuit 161 and the latch signal generator 162 are integrated into the PWM control circuit 16 normally a chip. Thus, in different inverter circuits, a detection circuit is designed based on actual selected PWM control circuit 16 to provide protection. In addition, parameters of the PWM control circuit 16 are fixed and cannot be modified.

DETAILED DESCRIPTION

Figure 1:
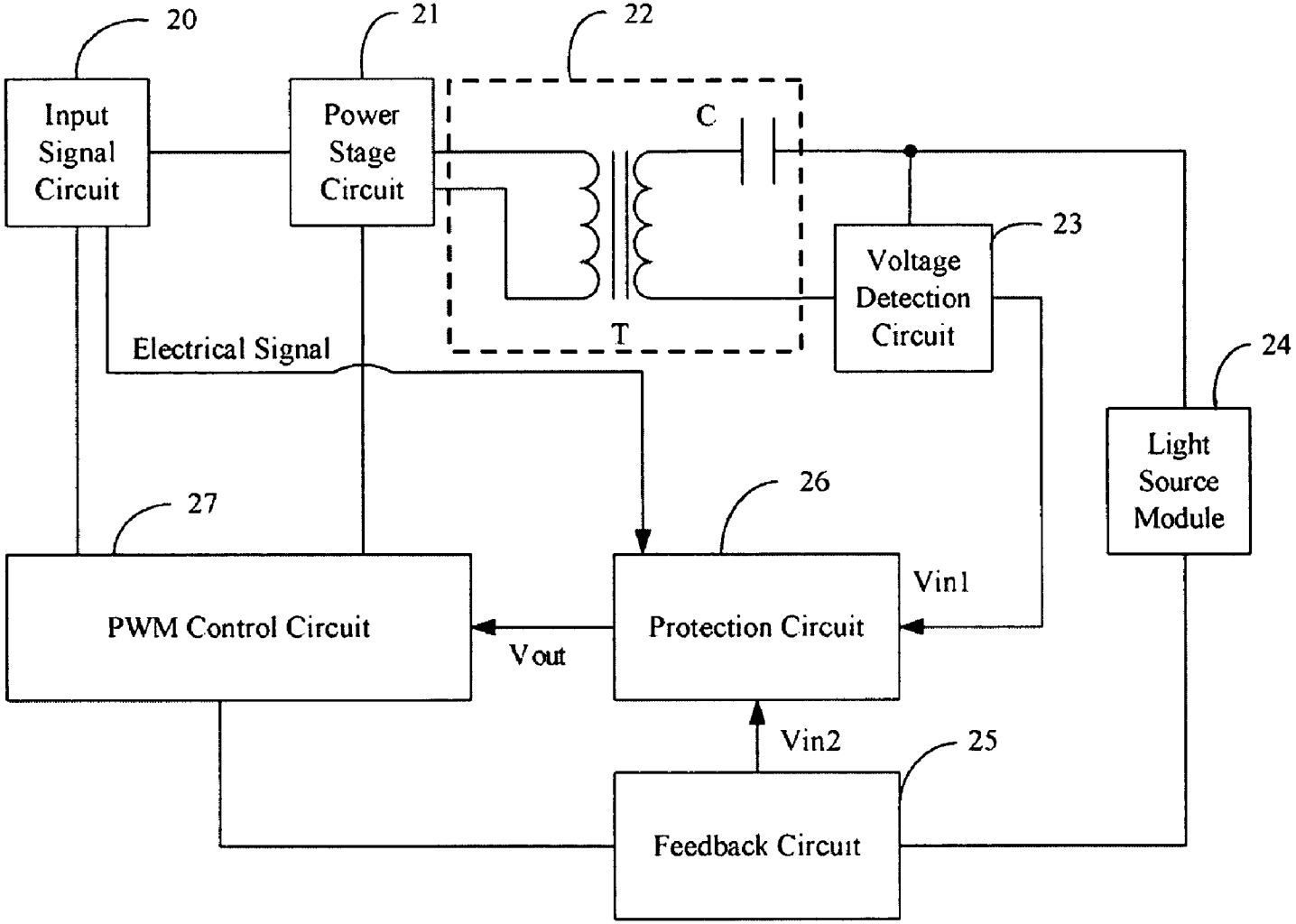
FIG. 1 is a block diagram of a first embodiment of an inverter circuit in accordance with the present disclosure.

FIG. 1 is a block diagram of a first embodiment of an inverter circuit to drive a light source module 24 in accordance with the present disclosure. In the illustrated embodiment, the inverter circuit comprises an input signal circuit 20, a power stage circuit 21, a transformer circuit 22, a voltage detection circuit 23, a feedback circuit 25, a protection circuit 26, and a PWM control circuit 27.

The input signal circuit 20 provides electrical signals. In one embodiment, the electrical signals comprise direct circuit (DC) signals or on/off signals. The power stage circuit 21 is connected to the input signal circuit 20 to convert the received DC signals into square-wave signals. The transformer circuit 22 is connected to the power stage circuit 21 to convert the square-wave signals to alternating current (AC) signals capable of driving the light source module 24. In one example, the AC signals are sine-wave signals. The transformer circuit 22 comprises a transformer T and a capacitor C. A primary winding of the transformer T is connected to the power stage circuit 21, and the secondary winding thereof is connected to the light source module 24 via the capacitor C. The voltage detection circuit 23 is connected between a high voltage terminal and a low voltage terminal of the secondary winding of the transformer T, for detecting voltage applied on the light source module 24 and output a detected voltage signal Vin1. When any lamp in the light source module 24 is disconnected, voltage overload on the transformer T occurs. Thus, there is a need to detect the voltage overload signal.

The feedback circuit 25 is connected between the light source module 24 and the PWM control circuit 27, for feeding current flowing through the light source module 24 to output a current feedback signal. The protection circuit 26 is connected to the input signal circuit 20, the voltage detection circuit 23, the feedback circuit 25 and the PWM control circuit 27, for outputting a latch signal Vout according to the detected voltage signal or the current feedback signal. In one embodiment, the feedback circuit 25 feeds the current flowing through the light source module 24 to the protection circuit 26 and the PWM control circuit 27, respectively.

In a normal state, the PWM control circuit 27 controls output of the power stage circuit 21 according to the current feedback signal. In an abnormal state, the voltage signal detected by the voltage detection circuit 23 or the current fed back by the current feedback circuit 25 are respectively beyond a voltage predetermined threshold or a current predetermined threshold, and the protection circuit 26 outputs a latch signal Vout to the PWM control circuit 27 according to the detected voltage signal Vin1 or the current feedback signal Vin2. Additionally, the PWM control circuit 27 is also connected to the input signal circuit 20 and the power stage circuit 21, for outputting a switch signal to the power stage circuit 21 according to the latch signal Vout. Here, the electrical signal output from the input signal circuit 20 is an external power signal of the protection circuit 26, that is, the input signal circuit 20 also provides electrical signals to the protection circuit 26. In one embodiment, the power stage circuit 21 stops converting the electrical signals to the square-wave signals once the switch signal is received.

Figure 2:
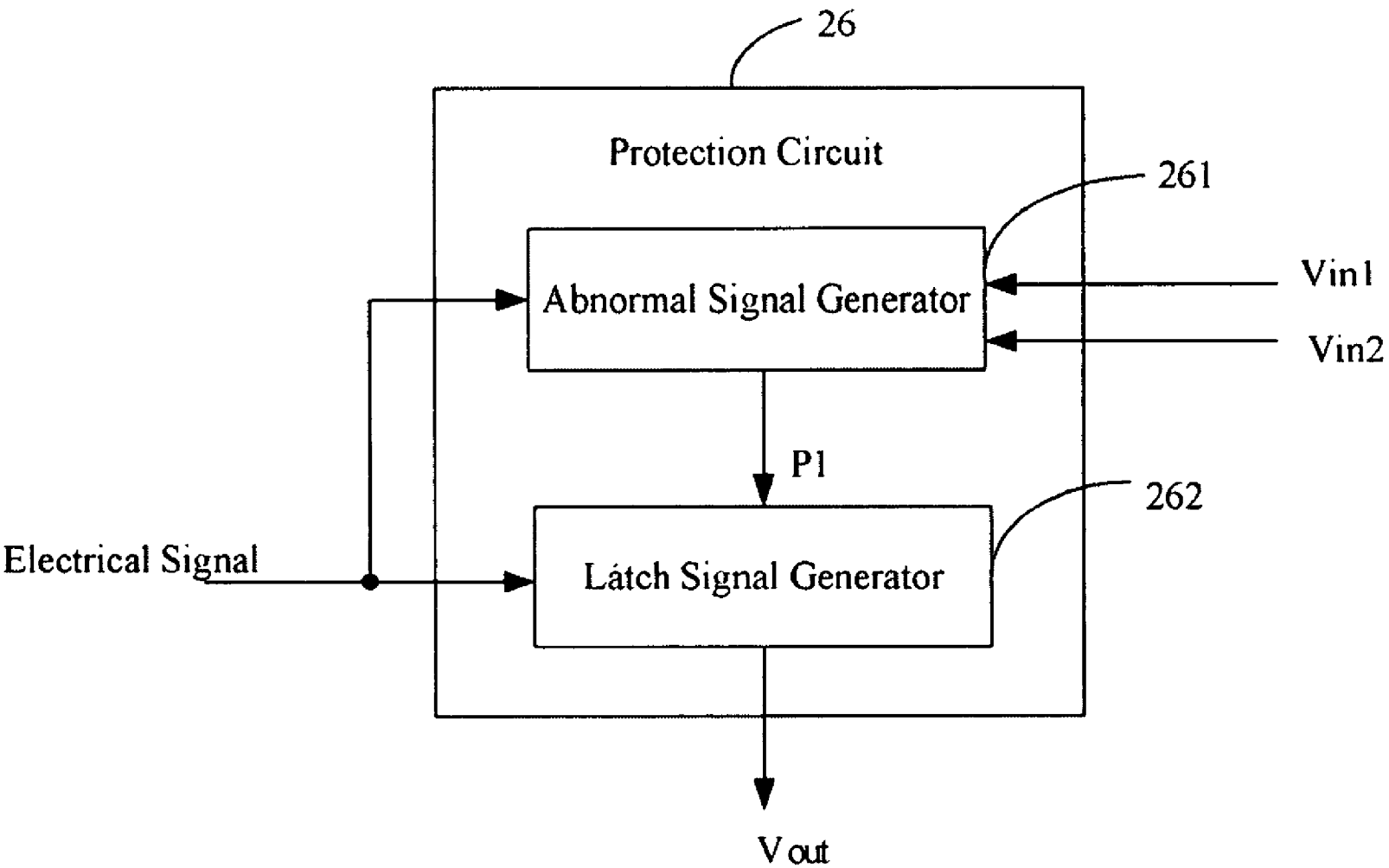
FIG. 2 is a block diagram of one embodiment of a protection circuit of FIG. 1.

FIG. 2 is a block diagram of one embodiment of the protection circuit 26. The protection circuit 26 comprises an abnormal signal generator 261 and a latch signal generator 262. Both the abnormal signal generator 261 and the latch signal generator 262 are connected to the input signal circuit 20, for receiving the electrical signals as the external power signal of the protection circuit 26. The abnormal signal generator 261 respectively compares the detected voltage signal Vin1 or the current feedback signal Vin2 to the voltage predetermined threshold or the current predetermined threshold. When the detected voltage signal Vin1 or the current feedback signal Vin2 respectively exceeds the voltage predetermined threshold or the current predetermined threshold, the abnormal signal generator 261 outputs an abnormal signal to an abnormal signal detection terminal P1 of the latch signal generator 262.

Here, when the voltage applied to or the current flowing through the light source module 24 is abnormal, the protection circuit 26 outputs a latch signal Vout, such as a high logic level (e.g., a logical 1), and, as the PWM control circuit 27 has no output to the power stage circuit 21, the inverter circuit is cut off. Because the electrical signals are the external power signals of the protection circuit 26, the latch signal Vout is output to the power stage circuit 21 continuously if the electrical signals are not cut off. In other words, the protection circuit 26 does not output the latch signal Vout only if the electrical signals are not provided to the protection circuit 26. In one embodiment, when the output of the input signal circuit 20 is cut off, the protection circuit 26 has no output and the inverter circuit is restarted.

Figure 3:
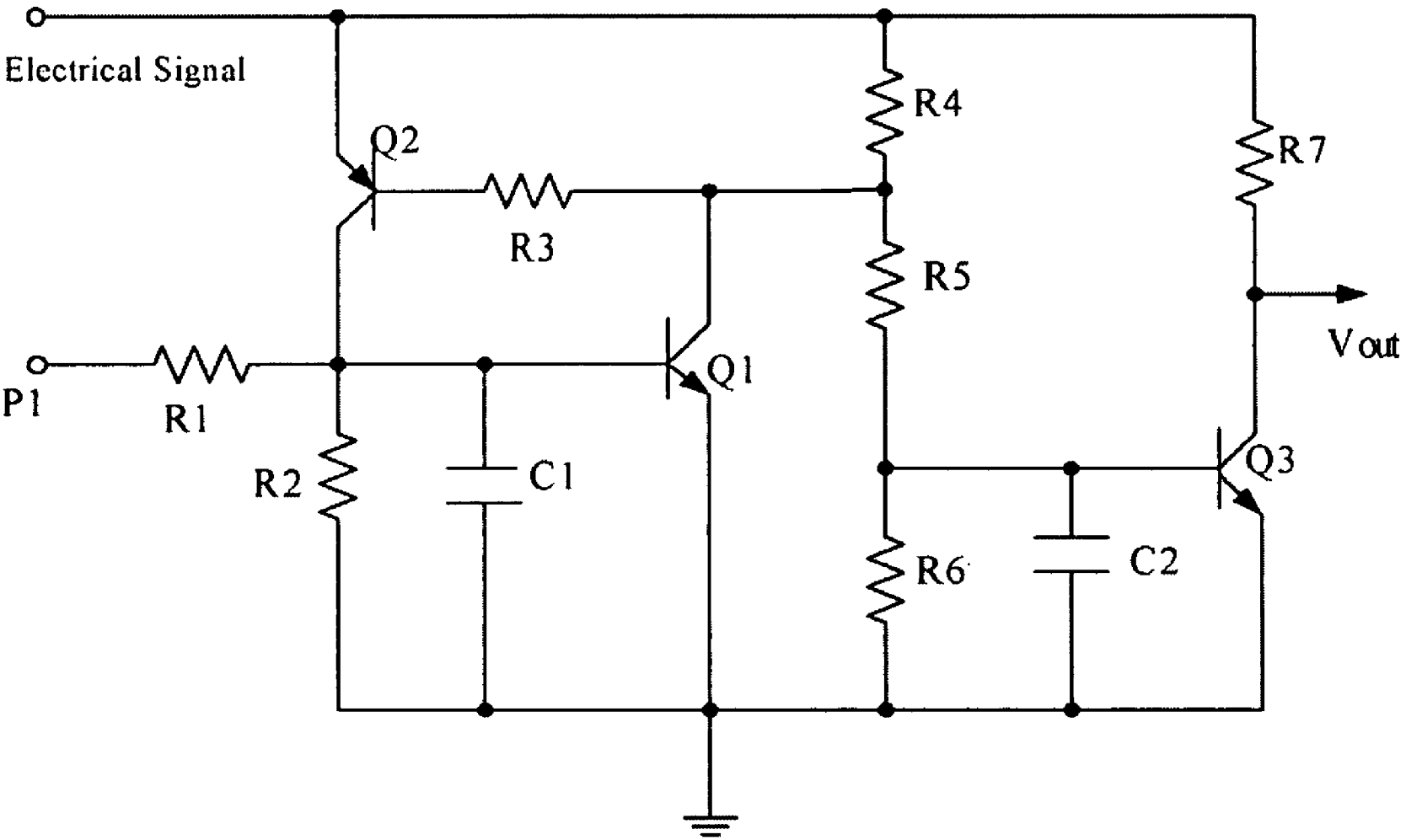
FIG. 3 is a detail circuit diagram of one embodiment of a latch signal generator of the protection circuit of FIG. 2.

FIG. 3 is a detailed circuit diagram of one embodiment of the latch signal generator 262. The latch signal generator 262 comprises a plurality of resistors R1, R2, R3, R4, R5, R6 and R7; a first capacitor C1, a second capacitor C2; a first transistor Q1, a second transistor Q2 and a third transistor Q3. Here, the first transistor Q1 and the third transistor Q3 are NPN transistors, and the second transistor Q2 is a PNP transistor.

A base of the transistor Q1 is connected to the abnormal signal detection terminal P1, and the emitter thereof is grounded. A base of the transistor Q2 is connected to a collector of the transistor Q1, an emitter thereof receives the electrical signals output from the input signal circuit 20, and a collector thereof is connected to the base of the transistor Q1. A base of the transistor Q3 also receives the electrical signals output from the input signal circuit 20, and a collector thereof is defined as an output of the protection circuit 26, for outputting the latch signal Vout, and an emitter thereof is grounded.

The resistor R1 is connected between the abnormal signal detection terminal P1 and the base of the transistor Q1, and the capacitor C1 is connected between the base of the transistor Q1 and ground. Here, the resistor R1 and the capacitor C1 form a delaying circuit to delay abnormal signal input to the abnormal signal detection terminal P1 to determine whether the abnormal signal is correct.

The resistor R2 is connected to the capacitor C1 in parallel, to form a discharge loop with the capacitor C1. When the inverter circuit is restarted, energy stored in the capacitor C1 is discharged via the resistor R2. In addition, when the transistor Q2 is on, the resistor R2 limits current therethrough.

The resistor R3 is connected between the collector of the transistor Q1 and the base of the transistor Q2, for providing a bias voltage to the transistor Q2.

One end of the fourth resistor R4 is connected to the input signal circuit 10 to receive the electrical signals, and the other end thereof is connected to the collector of the transistor Q1. The resistor R5 is connected between the collector of the transistor Q1 and the base of the transistor Q3, and the resistor R6 is connected between the base of the transistor Q3 and ground. The capacitor C2 is connected to the resistor R6 in parallel. Similarly, the resistor R5 and the capacitor C2 form another delaying circuit, and the resistor R6 and the capacitor C2 form another discharge loop.

The resistor R7 is connected between the input signal circuit 20 and the collector of the transistor Q3, for limiting current flowing through the transistor Q3.

When the protection circuit 26 receives no abnormal detected voltage signal Vin1 or abnormal current signal Vin2, that is, the abnormal signal detection terminal P1 of the latch signal generator 262 has no input, the transistors Q1, Q2 are off and the transistor Q3 is on. Thus, the collector of the transistor Q3 outputs a low logic level (e.g., a logical 0) as the latch signal Vout. When the abnormal detected voltage signal Vin1 or the abnormal current signal Vin2 is input to the protection circuit 26, that is, the abnormal signal detection terminal P1 of the latch signal generator 262 receives a signal, the transistors Q1 and Q2 are on and the transistor Q3 is off. Thus, the collector of the transistor Q3 outputs a high logic level as the latch signal Vout.

Figure 4:
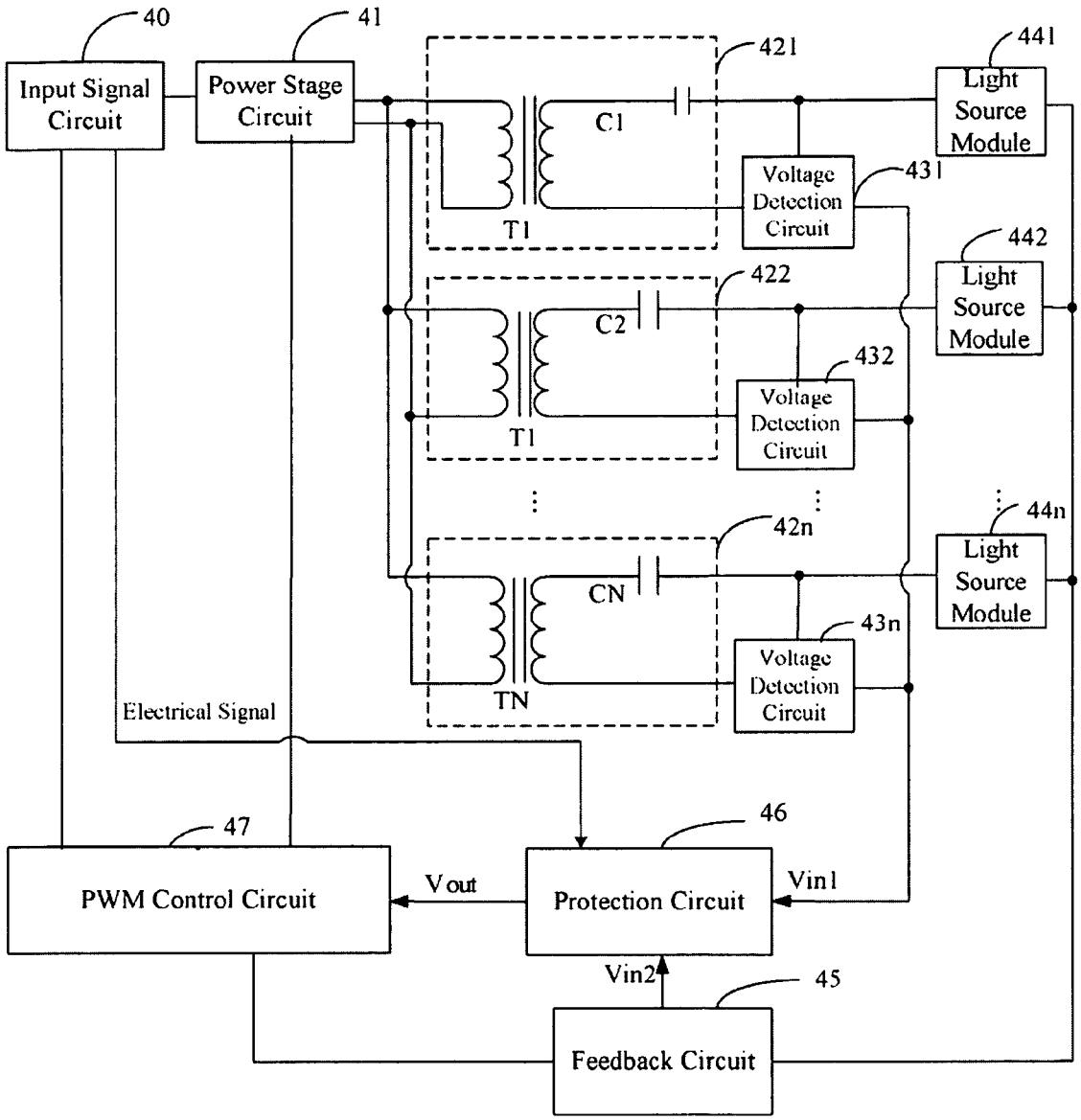
FIG. 4 is a block diagram of a second embodiment of an inverter circuit in accordance with the present disclosure.
Figure 5:
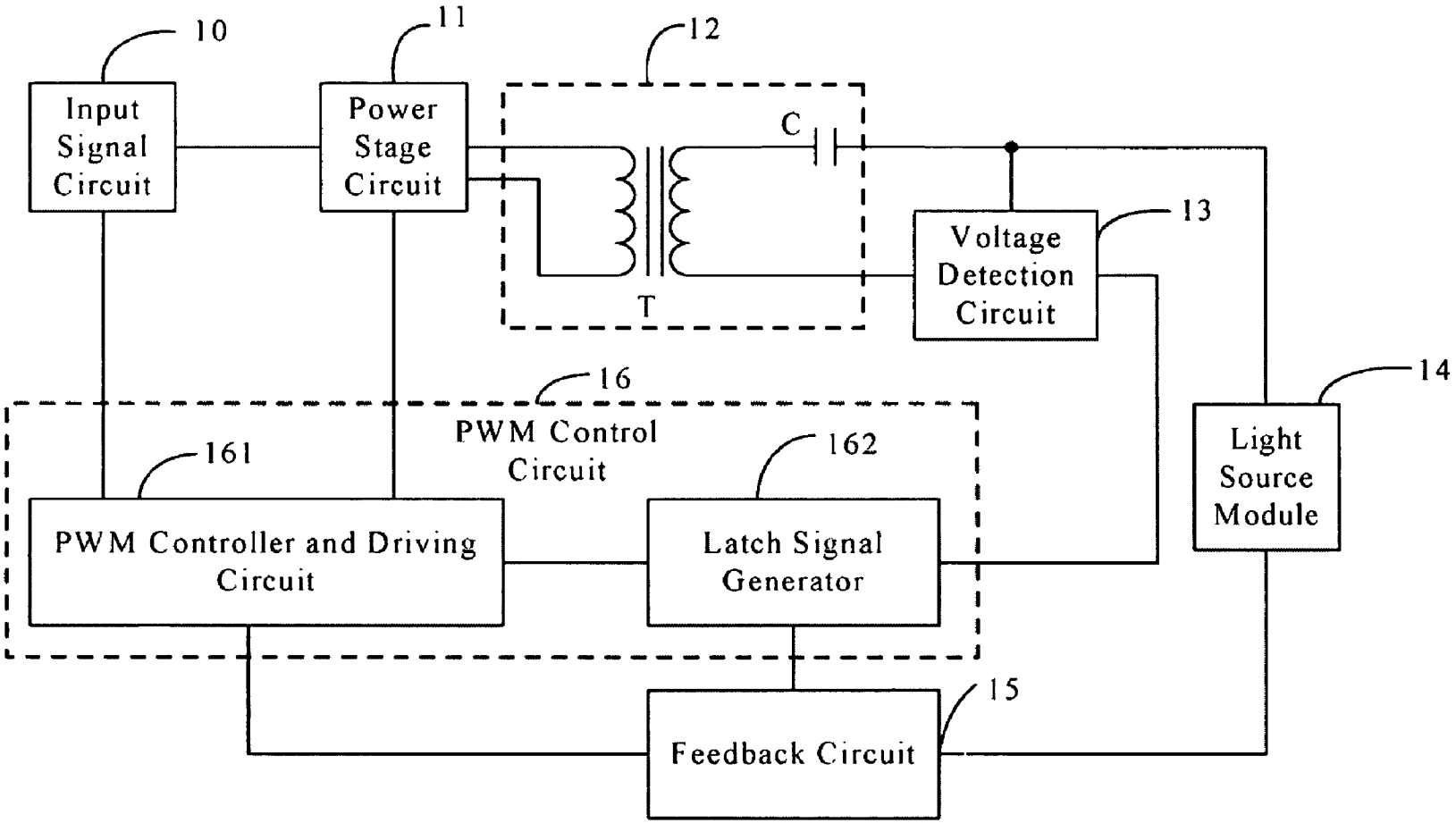
FIG. 5 (Related Art)
FIG. 5 is a block diagram of a commonly used inverter circuit.

FIG. 4 is a block diagram of a second embodiment of an inverter circuit in accordance with the present disclosure, differing from that of FIG. 1 only in the inclusion of a plurality of transformer circuits 42n (n=1, 2, 3, . . . , n), a plurality of voltage detection circuits 43n (n=1, 2, 3, . . . , n) and a plurality of light source modules 44n (n=1, 2, 3, . . . , n). Structure of each of the transformer circuits 42n (n=1, 2, 3, . . . , n) is the same as that of transformer circuit 42 of FIG. 1, and is thus omitted for brevity. Similarly, connections between the plurality of the transformer circuits 42n (n=1, 2, 3, . . . , n) and the light source modules 44n (n=1, 2, 3, . . . , n) are the same as those of transformer circuit 22 and the light source module 24, and are omitted accordingly.

In the inverter circuit, the protection circuit 26 functions independent of the PWM control circuit 27. Thus, in different inverter circuits with different PWM control circuits 16, protection circuits are not necessarily present.

Although the features and elements of the present disclosure are described in various inventive embodiment in particular combinations, each feature or element can be configured alone or in various within the principles of the present disclosure to the full extent indicated by the broad general meaning of the terms in which the appended claims are expressed.

What is claimed is:

1. An inverter circuit, configured for driving a light source module, comprising:

an input signal circuit that provides electrical signals;

a power stage circuit connected to the input signal circuit, the power stage circuit configured for converting the electrical signals into square-wave signals;

a transformer circuit connected between the power stage circuit and the light source module, the transformer circuit configured for converting the square-wave signals into alternating current (AC) signals capable of driving the light source module;

a voltage detection circuit electrically connected to the transformer circuit, the voltage detection circuit configured for detecting voltage applied to the light source module and outputting a detected voltage signal according to the detected voltage;

a feedback circuit connected to the light source module, the feedback circuit configured for feeding current flowing through the light source module to output a current feedback signal;

a protection circuit electrically connected to the voltage detection circuit and the feedback circuit, the protection circuit configured for outputting a latch signal according to the detected voltage signal or the current feedback signal; and a pulse-width modulation (PWM) control circuit connected to the power stage circuit and the protection circuit, the PWM control circuit configured for outputting a switch signal to control the power stage circuit to stop converting the electrical signals into the square-wave signals upon receiving the latch signal;

wherein the protection circuit further receives the electrical signals from the input signal circuit, and in response to the output of the input signal circuit being cut off, the protection circuit does not receive the electrical signals, no latch signal is output to the PWM control circuit, and no switch signal is output from the PWM control circuit to the power stage circuit, and the power stage circuit restarts to convert the electrical signals to the square-wave signals.

2. The inverter circuit as claimed in claim 1, wherein the electrical signals comprise direct current (DC) signals or on/off signals.

3. The inverter circuit as claimed in claim 1, wherein the PWM control circuit is connected to the feedback circuit, the PWM control circuit being further configured for controlling output of the power stage circuit according to the current feedback signal.

4. The inverter circuit as claimed in claim 1, wherein the transformer circuit comprises:

a transformer comprising a primary winding and a secondary winding, wherein the primary winding is connected to the power stage circuit, and wherein the secondary winding is connected to the light source module; and a capacitor connected between a high terminal of the secondary winding of the transformer and the light source module.

5. The inverter circuit as claimed in claim 4, wherein the voltage detection circuit is connected between the high terminal and a low terminal of the secondary winding of the transformer.

6. The inverter circuit as claimed in claim 1, wherein the protection circuit comprises:

an abnormal signal generator, configured for comparing the voltage detected signal or the current feedback signal respectively to a voltage predetermined threshold and a current predetermined threshold, and outputting an abnormal voltage signal or an abnormal current signal when the detected voltage signal or the current feedback signal respectively exceeds the voltage predetermined threshold or the current predetermined threshold; and a latch signal generator connected to the abnormal signal generator, the latch signal generator configured for outputting a latch signal according to the abnormal voltage signal or the abnormal current signal;

wherein both the abnormal signal generator and the latch signal generator are connected to the input signal circuit for receiving the electrical signals.

7. The inverter circuit as claimed in claim 6, wherein the latch signal generator comprises:

a first transistor comprising a base connected to the abnormal signal generator and an emitter being grounded;

a second transistor comprising a base connected to a collector of the first transistor, an emitter connected to the input signal circuit, and a collector connected to the base of the first transistor; and a third transistor comprising a base connected to the power stage circuit, a collector that outputs the latch signal and connected to the PWM control circuit, and an emitter being grounded;

wherein when the first transistor and the second transistor are off, the third transistor is on and the latch signal is in a low logic level; when the first transistor and the second transistor are on, the third transistor is off and the latch signal is in a high logic level.

8. The inverter circuit as claimed in claim 7, wherein the first transistor and the third transistor are NPN transistors, and the second transistor is a PNP transistor.

9. The inverter circuit as claimed in claim 1, wherein the AC signals are sine-wave signals.

10. An inverter circuit, configured for driving a plurality of light source modules, comprising:

an input signal circuit configured for providing electrical signals;

a power stage circuit connected to the input signal circuit, the power stage circuit configured for converting the electrical signals to square-wave signals;

a plurality of transformer circuits connected between the power stage circuit and the plurality of light source modules, the transformer circuits configured for converting the square-wave signals to alternating current (AC) signals capable of driving the light source modules;

a plurality of voltage detection circuits electrically connected to the transformer circuits, the voltage detection circuits configured for detecting voltages applied to the plurality of light source modules and outputting detected voltage signals according to the detected voltage;

a feedback circuit connected to the plurality of light source modules, the feedback circuit configured for feeding current flowing through the light source modules to output a current feedback signal;

a protection circuit electrically connected to the plurality of voltage detection circuits and the feedback circuit, the protection circuit configured for outputting a latch signal according to the detected voltage signals or the current feedback signal; and a pulse-width modulation (PWM) control circuit connected to the power stage circuit and the protection circuit, the PWM control circuit configured for outputting a switch signal to control the power stage circuit to stop converting the electrical signals into the square-wave signals upon receiving the latch signal;

wherein the protection circuit further receives the electrical signals from the input signal circuit, and in response to the output of the input signal circuit being cut off, the protection circuit does not receive the electrical signals, no latch signal is output to the PWM control circuit, and no switch signal is output from the PWM control circuit to the power stage circuit, and the power stage circuit restarts to convert the electrical signals to the square-wave signals.

11. The inverter circuit as claimed in claim 10, wherein the electrical signal comprises a direct current (DC) signal or an on/off signal.

12. The inverter circuit as claimed in claim 10, wherein the PWM control circuit is connected to the feedback circuit, the PWM control circuit configured for controlling the output of the power stage circuit according to the current feedback signal.

13. The inverter circuit as claimed in claim 10, wherein each of the plurality of transformer circuits comprises:

a transformer comprising a primary winding and a secondary winding, wherein the primary winding is connected to the power stage circuit, and wherein the secondary winding is connected to the light source module; and a capacitor connected between a high terminal of the secondary winding of the transformer and the light source module.

14. The inverter circuit as claimed in claim 13, wherein the plurality of voltage detection circuits is connected between the high terminal and a low terminal of the secondary winding of the corresponding transformer.

15. The inverter circuit as claimed in claim 10, wherein the protection circuit comprises:

an abnormal signal generator, configured for comparing the voltage detected signal or the current feedback signal respectively to a voltage predetermined threshold and a current predetermined threshold, and outputting an abnormal voltage signal or an abnormal current signal when the detected voltage signal or the current feedback signal respectively exceeds the voltage predetermined threshold or the current predetermined threshold; and a latch signal generator connected to the abnormal signal generator, the latch signal generator configured for outputting a latch signal according to the abnormal voltage signal or the abnormal current signal;

wherein the abnormal signal generator and the latch signal generator are connected to the input signal circuit for receiving the electrical signals.

16. The inverter circuit as claimed in claim 15, wherein the latch signal generator comprises:

a first transistor comprising a base connected to the abnormal signal generator and an emitter being grounded;

a second transistor comprising a base connected to a collector of the first transistor, an emitter connected to the input signal circuit, and a collector connected to the base of the first transistor; and a third transistor comprising a base connected to the power stage circuit, a collector that outputs the latch signal and connected to the PWM control circuit, and an emitter being grounded;

wherein when the first transistor and the second transistor are off, the third transistor is on and the latch signal is in a low logic level; when the first transistor and the second transistor are on, the third transistor is off and the latch signal is in a high logic level.

17. The inverter circuit as claimed in claim 16, wherein the first transistor and the third transistor are NPN transistors, and the second transistor is a PNP transistor.

18. The inverter circuit as claimed in claim 10, wherein the AC signals are sine-wave signals.

* * * * *